US008167563B2

(12) United States Patent
Kayser

(10) Patent No.: US 8,167,563 B2
(45) Date of Patent: May 1, 2012

(54) BLADE ARRANGEMENT

(75) Inventor: Andreas Kayser, Wuppertal (DE)

(73) Assignee: Siemens Aktiengesellschaft, Munich (DE)

( * ) Notice: Subject to any disclaimer, the term of this patent is extended or adjusted under 35 U.S.C. 154(b) by 539 days.

(21) Appl. No.: 12/515,845

(22) PCT Filed: Oct. 25, 2007

(86) PCT No.: PCT/EP2007/061469

§ 371 (c)(1), (2), (4) Date: May 21, 2009

(87) PCT Pub. No.: WO2008/061856

PCT Pub. Date: May 29, 2008

(65) Prior Publication Data

US 2010/0021302 A1 Jan. 28, 2010

(30) Foreign Application Priority Data

Nov. 23, 2006 (EP) ..... 06024326

(51) Int. Cl.
*F01D 5/26* (2006.01)

(52) U.S. Cl. ..... 416/190; 416/193 A; 416/500

(58) Field of Classification Search ..... 415/119; 416/190, 193 A, 500

See application file for complete search history.

(56) References Cited

U.S. PATENT DOCUMENTS

| | | | | |
|---|---|---|---|---|
| 2,310,412 | A * | 2/1943 | Fianders | 416/190 |
| 2,942,843 | A | 6/1956 | Sampson | |
| 4,580,946 | A | 4/1986 | Bobo | |
| 4,917,574 | A * | 4/1990 | Dodd et al. | 416/193 A |
| 5,143,517 | A * | 9/1992 | Vermont | 416/190 |
| 5,520,514 | A * | 5/1996 | Mareix et al. | 416/193 A |
| 6,478,544 | B2 * | 11/2002 | Brandl et al. | 416/190 |

FOREIGN PATENT DOCUMENTS

| | | | |
|---|---|---|---|
| EP | 0509838 | A1 | 4/1992 |
| EP | 0 918 139 | A2 | 5/1999 |
| EP | 1 154 125 | A2 | 11/2001 |
| JP | 2006125372 | A | 5/2006 |
| SU | 128868 | A1 | 1/1960 |
| SU | 1127979 | A | 12/1984 |

* cited by examiner

*Primary Examiner* — Igor Kershteyn

(57) ABSTRACT

A blade arrangement, with a rotor and a plurality of blades which are arranged on the periphery of the rotor in a ring, and a plurality of damping elements are provided. Between two directly adjacent blades at least two damping elements are arranged in series in the circumferential direction of the rotor. As a result of a centrifugal force, which acts in the radial direction, during a rotation of the rotor around a rotor axis adjacent damping elements come into contact with each other, and one of the two damping elements comes into contact with one of the two blades and the other of the two damping elements comes into contact with the other of the two blades.

14 Claims, 1 Drawing Sheet

BLADE ARRANGEMENT

CROSS REFERENCE TO RELATED APPLICATIONS

This application is the U.S. National Stage of International Application No. PCT/EP2007/061469, filed Oct. 25, 2007 and claims the benefit thereof. The International Application claims the benefits of European Patent Office application No. 06024326.8 EP filed Nov. 23, 2006, both of the applications are incorporated by reference herein in their entirety.

FIELD OF INVENTION

The invention refers to a blade arrangement, with a rotor and a plurality of blades which are arranged on the periphery of the rotor in a ring, wherein between two directly adjacent blades at least two damping elements are arranged in series in the circumferential direction of the rotor, and wherein as a result of a centrifugal force, which acts in the radial direction, during a rotation of the rotor around a rotor axis adjacent damping elements come into contact with each other, and one of the two damping elements comes into contact with one of the two blades and the other of the two damping elements comes into contact with the other of the two blades.

BACKGROUND OF INVENTION

It is known to provide blade arrangements which are used in turbomachines, such as gas turbines, with damping elements. These serve for damping unwanted flexural and torsional vibrations which occur during operation in the turbomachine as a result of various excitations. In this way, HCF damage (short for "High-Cycle Fatigue" damage), which is induced as a result of high vibration amplitudes and which can lead to early material fatigue and consequently to a curtailed service life of the blades or of the blade arrangement, can be avoided. The damping elements in this case are arranged between the individual blades. As damping elements, as a rule movable bodies are used, which in the quiescent state first bear between the blade roots of the blades on the rotor or on corresponding support structures, and during operation of the rotor are pressed against the underside of the blade platforms of adjacent blades on account of the centrifugal force which acts in the radial direction. In the process each damping element comes into contact with the two adjacent blade platforms at the same time. As a result of this, the kinetic energy of a relative movement between the blades which is induced on account of vibrations can be converted into heat energy, as a result of the friction between the respective blade platforms and the abutting damping element. This damps the vibrations and altogether leads to a reduced vibrational load of the blade arrangement.

A blade arrangement, in which at least two damping elements are arranged between adjacent blades in series in the circumferential direction of the rotor in order to achieve an effective damping of the entire blade arrangement, is known from publication EP 1 154 125 A2. The damping elements which are disclosed in this publication are constructed in differing forms in order to be able to damp as large a number as possible of different vibration modes. Via the contact regions between the damping elements and the blades, and furthermore via the contact regions which are formed between the individual damping elements, vibrational energy can be converted into heat energy for vibration damping by means of friction action. However, the contact regions which are formed between the individual damping elements only have the form of a linear contact, with which is associated an only slightly pronounced damping action.

SUMMARY OF INVENTION

The invention is based on the object of disclosing a blade arrangement with damping elements, with which unwanted vibrations can be damped even more effectively.

This object is achieved according to the invention with the blade arrangement which is referred to in the introduction, in which the damping elements are formed and arranged in series in the circumferential direction of the rotor in such a way that two of the three contacts between the damping elements and the blades are of a planar type, and one of the two contacts is of a linear type. By means of this combination of two differently acting damping elements a large number of different vibration states can be effectively damped, wherein in addition to antiphase vibration states equiphase vibrations are also damped since as a result of the planar contacts of the wedge-shaped damping element a rolling-off of the circular element on the linear contact with the platform is prevented. By means of the combination of these damping elements with a planar contact on one blade platform and a linear contact (Hertzian contact) on the other platform of the blade pair, a kinematically stable arrangement is created, which prevents tilting and local lifting of all the contact surfaces.

In the design according to the invention of a blade arrangement the position of the damping elements is neither underdefined nor overdefined. As a result of this, a best-possible damping with a split damper can be achieved. The contact regions of adjacent damping elements, which are formed during rotor rotation, are preferably in the form of a planar contact. In this way, the entire friction surface which is made available between the damping elements is noticeably increased compared with known blade arrangements in which the damping elements come into contact with each other only in the form of a linear contact. Increasing the friction surface according to the invention brings about a very effective vibration damping of the entire blade arrangement. Different vibration modes can also be effectively damped in this way. When considered overall, the blade arrangement according to the invention enables a reduction of the vibration amplitudes and stresses by means of additional friction damping.

In a further development, the contact between one of the two damping elements and one of the two blades is a planar contact and the contact of the other damping element and the other blade is a linear type of contact. Naturally, as an alternative the single linear contact could also be provided between the damping elements.

In an advantageous development, the damping elements differ in their geometric shape. According to the invention, vibration modes, which in the case of an unvaried configuration of all the damping elements cannot be effectively damped, can also be effectively damped with suitably formed damping elements in this way. The damping elements can preferably also differ in their masses in order to effectively damp as large a number as possible of different vibration modes by combination with suitable geometric shapes. In addition, by using damping elements consisting of different materials the friction conditions (friction coefficient, roughness) in the contact regions can be influenced in order to also enable in this way a purposeful damping of a plurality of modes, even in increased frequency ranges.

In order to be able to suitably arrange the damping elements between adjacent blades, these damping elements are preferably designed in a bar-like form.

In a concrete development of the blade arrangement according to the invention, two damping elements are arranged in series in the circumferential direction of the rotor, wherein the damping elements are preferably designed in a bar-like form and one damping element has a cross section of the shape of a wedge and the other damping element has a cross section of the shape of a quadrant. The advantages according to the invention can especially be achieved as a result of such cross-sectional shapes of the damping elements which are matched to each other.

In an alternative advantageous development, three damping elements are arranged in series in the circumferential direction of the rotor. By means of a further damping element, which preferably has a geometric shape which is different to the rest of the damping elements, further disturbing vibration modes can be effectively damped if necessary. In this case, only the two outer damping elements, which are arranged in series in the circumferential direction of the rotor, preferably come into contact with the blades of the blade pair via friction surfaces which are formed on the blades of the blade pair. Depending upon the application case, it can also be advantageous to arrange more than three damping elements in series between two adjacent blades.

In a further concrete development, the damping elements are produced from steel or ceramic, that is to say materials with which an effective damping can be realized.

BRIEF DESCRIPTION OF THE DRAWINGS

An exemplary embodiment of a blade arrangement according to the invention is subsequently explained in more detail with reference to the attached drawing, in which FIG. 1 schematically shows a detail of a blade arrangement according to the invention in a plane of section which is perpendicular to the rotor axis, and FIG. 2 schematically shows the arrangement of two damping element groups over the axial extent of a blade.

DETAILED DESCRIPTION OF INVENTION

Figure 1:
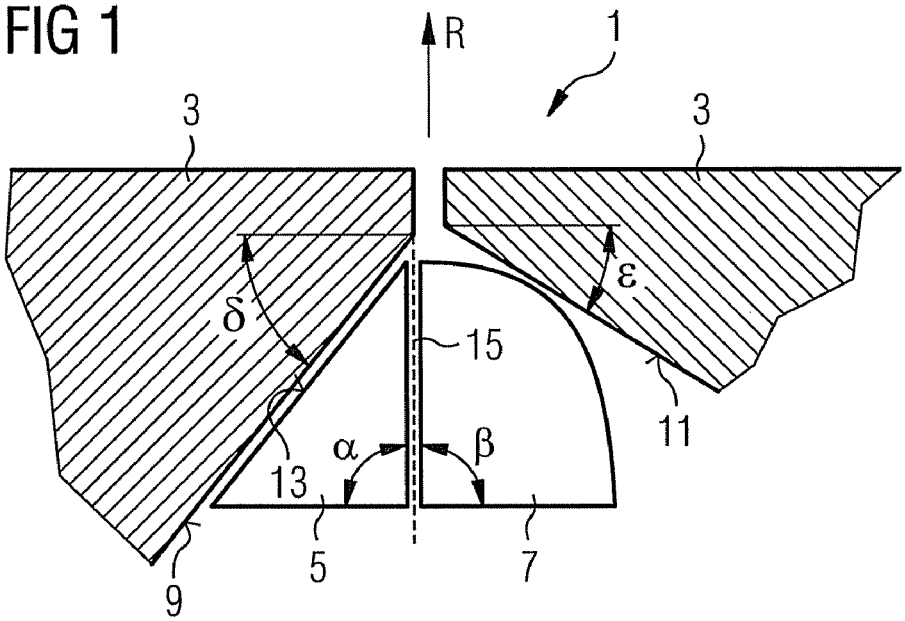

FIG. 1 shows a schematic detail of the blade arrangement 1 according to the invention in a plane of section which is perpendicular to the rotor axis. The detail shows two blade platforms 3 of adjacent blades of the blade arrangement 1 according to the invention. The blades are suspended on the rotor disk of the blade arrangement 1 and have a small distance to each other. Between the two blade platforms 3 two damping elements 5 and 7 are movably arranged. The two damping elements 5, 7 form a damper group and are designed in a bar-like form in the axial direction, wherein the damping element 7 has a quadrant-shaped cross section and the damping element 5 has a wedge-shaped cross section.

The undersides of the two blade platforms 3 form friction surfaces 9, 11. The two damping elements 5, 7, during a rotation of the rotor (not shown), are pressed against these friction surfaces 9, 11 as a result of centrifugal force action. The friction surfaces 9, 11 in the present case are inclined by specific angles $\delta$ and $\epsilon$ to the plane which is spanned by the radial direction R and the rotor axis, so that together they form a V-shaped guide into which the damping elements 5, 7 are pressed as a result of the centrifugal force. The wedge-shaped damping element 5 has a friction surface 13, the inclination of which is adapted to the angle $\delta$ in order to provide an effective planar frictional contact between the damping element 5 and the corresponding blade platform 3. The angles $\delta$ and $\epsilon$ in this case lie preferably within the range of 20° to 70°, wherein the range of 40° to 60° is more preferable.

When using the blade arrangement 1 according to the invention in a turbomachine, such as a gas turbine, unwanted vibrations in the form of flexural and torsional vibrations often develop in the blade arrangement 1 as a result of various excitations. These vibrations as a rule cause a relative movement between the two adjacent blade platforms 3 which in turn lead to a relative movement between the wedge-shaped damping element 5 and the friction surface 9, and between the quadrant-shaped damping element 7 and the friction surface 11, and lead to a relative movement between the two damping elements 5 and 7 in the contact region 15 (shown schematically in FIG. 1 by means of a broken line). In this way, according to the invention, in all three contact regions vibration energy can be converted into heat energy as a result of friction in order to achieve an effective vibration damping. In this case, particularly vibrations which also occur in antiphase are effectively damped with the wedge-shaped damping element 5.

According to the invention, the damping elements 5 and 7 are formed and arranged in series in the circumferential direction of the rotor in such a way that the contact in the contact region 15 is a planar contact 15, just like the contact between damping element 5 and platform 3. In this way, the entire friction surface which is made available between the damping elements 5 and 7 is noticeably increased compared with known blade arrangements in which the contact region between the damping elements is not formed as a planar contact but in the form of a linear contact (Hertzian contact). Unlike known solutions, in which when using two damping elements two linear contacts and one planar contact are provided, according to the invention there are two planar contacts and only one linear contact (specifically between damping element 7 and platform 3). The friction surface which is additionally provided according to the invention via the planar contact 15 brings about a very effective vibration damping of the entire blade arrangement 1.

In the present case, the planar contact 15 extends parallel to the radial direction R, but can also be inclined to the radial direction R by correspondingly selected angles $\alpha$ and $\beta$. In this case, the angle $\alpha$ preferably lies within a range of 70° to 90°, and the angle $\beta$ lies within a range of 110° to 90°, or vice versa.

Figure 2:
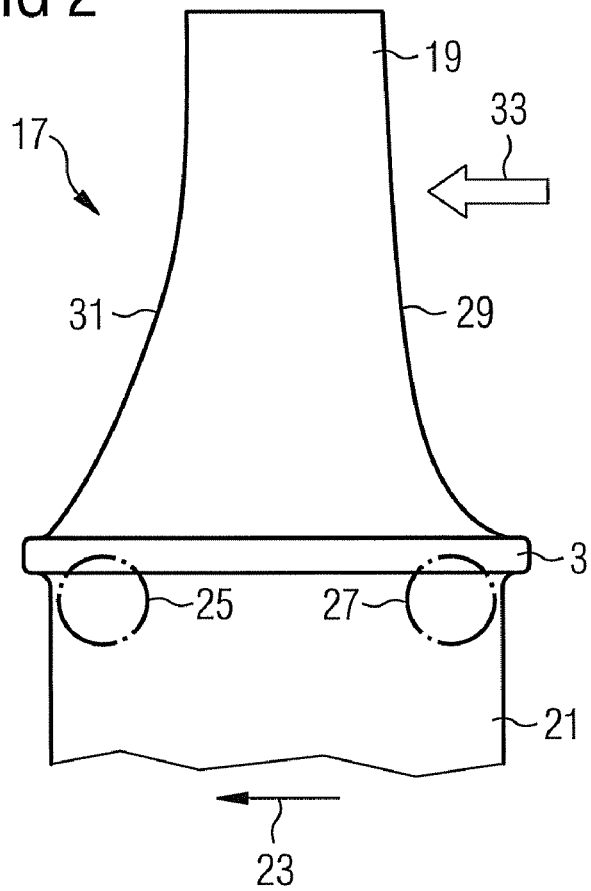

FIG. 2 schematically shows the arrangement of two damping element groups 25, 27. The positions of the damping element groups 25 and 27, which comprise in each case a specific number of damping elements, are schematically indicated by means of circles. The damping elements extend in a bar-like manner in the axial direction, wherein the groups are distributed along the axial extent of a blade 17 (axial direction 23). The blade 17 comprises a blade airfoil 19, a blade platform 3, a blade root 21, a blade leading edge 29 and a blade trailing edge 31. In the present case, the damping element group 27 is located on the blade leading edge 29 and the damping element group 25 is located on the blade trailing edge 31. The flow direction 33 is indicated by means of an arrow. As a result of an asymmetrical arrangement or configuration of the groups 25, 27 in the axial direction 23, according to the invention different vibration modes can be effectively damped.

The invention claimed is:

1. A blade arrangement, comprising:

a rotor;

a plurality of blades arranged in a ring on a periphery of the rotor;

a first damping element; and a second damping element, wherein between two adjacent blades the first damping element and the second damping element are arranged in series in a circumferential direction of the rotor, wherein as a result of a centrifugal force acting in a radial direction during a rotation of the rotor around a rotor axis the first damping element and the second damping element which are adjacent come into a first contact with each other, the first damping element comes into a second contact with a first blade, and the second damping element comes into a third contact with a second blade, and wherein two of the three contacts are a planar type of contact and one of the three contacts is a linear type of contact.

2. The blade arrangement as claimed in claim 1, wherein the first damping element and the second damping element are formed and arranged in series in the circumferential direction of the rotor so that the first contact is the planar type of contact, wherein the second contact is the planar type of contact, and wherein the third contact is the linear type of contact.

3. The blade arrangement as claimed in claim 2, wherein the first damping element and the second damping element each have a different geometric shape.

4. The blade arrangement as claimed in claim 1, wherein the first damping element and the second damping element each have a different geometric shape.

5. The blade arrangement as claimed in claim 1, wherein the first damping element and the second damping element each have a different mass.

6. The blade arrangement as claimed in claim 1, wherein the first damping element and the second damping element are designed in a bar-like form.

7. The blade arrangement as claimed in claim 6, wherein the first damping element has a first cross section of a shape of a wedge and the second damping element has a second cross section of the shape of a quadrant.

8. The blade arrangement as claimed in claim 1, wherein the first damping element and the second damping element are designed in the bar-like form, and wherein the first damping element has the cross section of the shape of the wedge and the second damping element has the cross section of the shape of the quadrant.

9. The blade arrangement as claimed in claim 1, wherein three damping elements are arranged in series in the circumferential direction of the rotor.

10. The blade arrangement as claimed in claim 1, wherein the first damping element and the second damping element are produced from steel or ceramic.

11. The blade arrangement as claimed in claim 1, wherein a first friction surface and a second friction surface exist on the underside of the two adjacent blades, wherein during the rotation of the rotor, the first and second damping elements are pressed again the first friction surface and the second friction surface, respectively, wherein the first friction surface is inclined by a first angle to a plane which is spanned by a radial direction and by the rotor axis, wherein the second friction surface is inclined by a second angle to the plane which is spanned by the radial direction and by the rotor axis, and wherein the first angle and the second angle both lie within a range of 20° to 70°.

12. The blade arrangement as claimed in claim 1, wherein the planar contact is parallel to a radial direction.

13. The blade arrangement as claimed in claim 1, wherein the planar contact is inclined to the radial direction by a third angle and a fourth angle, wherein the third angle lies within the range of 70° to 90°, and wherein the fourth angle lies within the range of 110° to 90°.

14. The blade arrangement as claimed in claim 1, wherein the blade arrangement includes two damping element groups, wherein the two damping element groups each comprise a plurality of damping elements, wherein the plurality of damping elements extend bar-like in an axial direction, and wherein the two damping element groups are distributed along an axial extent of a blade.

* * * * *